US007188816B2

(12) United States Patent
Aoki et al.

(10) Patent No.: US 7,188,816 B2
(45) Date of Patent: Mar. 13, 2007

(54) PALLET FOR COIL-LIKE TRANSFERRED OBJECT, STRUCTURAL BODY FOR LOADING COIL-LIKE TRANSFERRED OBJECT ON PALLET, STRUCTURAL BODY FOR STORING COIL-LIKE TRANSFERRED OBJECT LOADING PALLET IN CONTAINER, AND TRANSFERRING METHOD

(75) Inventors: Tatsuhiko Aoki, Tokai (JP); Nobuaki Itou, Tokai (JP); Nobuhiro Kato, Tokai (JP)

(73) Assignee: Toyota Steel Center Co., Ltd., Aichi (JP)

( * ) Notice: Subject to any disclaimer, the term of this patent is extended or adjusted under 35 U.S.C. 154(b) by 0 days.

(21) Appl. No.: 10/380,957

(22) PCT Filed: Aug. 9, 2002

(86) PCT No.: PCT/JP02/08186

§ 371 (c)(1),
(2), (4) Date: Aug. 22, 2003

(87) PCT Pub. No.: WO03/013961

PCT Pub. Date: Feb. 20, 2003

(65) Prior Publication Data

US 2004/0028509 A1 Feb. 12, 2004

(30) Foreign Application Priority Data

Aug. 10, 2001 (JP) ..... 2001-244088

(51) Int. Cl.
*A47B 91/00* (2006.01)
*A47G 29/00* (2006.01)
*B65D 19/00* (2006.01)

(52) U.S. Cl. ..... 248/346.02; 248/346.01; 248/346.5; 410/100; 108/51.11; 108/52.1

(58) Field of Classification Search ..... 248/346.02, 248/346.03, 346.04, 346.06, 346.5; 410/80, 410/100; 108/51.11, 52.1, 55.1, 53.1, 53.3, 108/57.13, 57.14
See application file for complete search history.

(56) References Cited

U.S. PATENT DOCUMENTS 3,187,690 A * 6/1965 Desbois ..... 108/57.33

(Continued)

FOREIGN PATENT DOCUMENTS

JP 48-91762 11/1973

(Continued)

*Primary Examiner*—Amy J. Sterling
(74) *Attorney, Agent, or Firm*—Morgan, Lewis & Bockius, LLP

(57) ABSTRACT

A pallet P of the present invention consists of a pallet main body 1, four mount sections 2 provided on the pallet main body 1, and a lower open space 5 provided below the pallet main body 1 and having open four sides. The pallet main body 1 has an abutment frame section 3 which can abut on an inner wall of a dry container A and other pallets P. According to this pallet P, if a predetermined number of pallets P are contained in the container A, the abutment frame sections 3 abut on the other pallets P, whereby a predetermined number of coiled carrying articles C which are loaded on the pallets P vertically are arranged in a zigzag fashion.

14 Claims, 12 Drawing Sheets

U.S. PATENT DOCUMENTS

| | | | | | |
|---|---|---|---|---|---|
| 3,603,273 | A | * | 9/1971 | Riffe | 108/57.32 |
| 3,695,187 | A | * | 10/1972 | Weiss | 108/54.1 |
| 3,780,893 | A | | 12/1973 | Lässig et al. | |
| 3,857,501 | A | | 12/1974 | Lassig et al. | |
| 4,240,549 | A | * | 12/1980 | Hogg | 206/303 |
| 4,257,523 | A | * | 3/1981 | Blasio | 206/303 |
| 4,890,560 | A | * | 1/1990 | Good | 108/53.1 |
| 4,944,398 | A | * | 7/1990 | Gatt | 206/507 |
| 5,086,927 | A | * | 2/1992 | Bach et al. | 206/597 |
| 5,193,700 | A | | 3/1993 | Lyman et al. | 220/1.5 |
| D348,341 | S | * | 6/1994 | Costenaro | D34/38 |
| 5,520,121 | A | * | 5/1996 | Schubart et al. | 108/57.1 |
| 5,588,371 | A | * | 12/1996 | Looker | 108/57.12 |
| 5,829,363 | A | * | 11/1998 | Reilly | 108/55.1 |
| 5,829,592 | A | * | 11/1998 | Henry et al. | 206/416 |
| 6,065,923 | A | * | 5/2000 | Foster | 414/401 |
| 6,276,285 | B1 | * | 8/2001 | Ruch | 108/57.13 |
| 6,379,107 | B1 | * | 4/2002 | Iwasaki et al. | 414/809 |
| 6,561,739 | B1 | * | 5/2003 | Garala | 410/46 |

FOREIGN PATENT DOCUMENTS

| | | | | |
|---|---|---|---|---|
| JP | 58-41326 | U | | 3/1983 |
| JP | 62-118030 | U | | 7/1987 |
| JP | 5-96427 | | | 4/1993 |
| JP | 05096427 | | | 4/1993 |
| JP | 6-72443 | | | 3/1994 |
| JP | 06-072443 | | * | 3/1994 |
| JP | 06072443 | | | 3/1994 |
| JP | 6-156497 | | | 6/1994 |
| JP | 8-58791 | | | 3/1996 |

* cited by examiner

PALLET FOR COIL-LIKE TRANSFERRED OBJECT, STRUCTURAL BODY FOR LOADING COIL-LIKE TRANSFERRED OBJECT ON PALLET, STRUCTURAL BODY FOR STORING COIL-LIKE TRANSFERRED OBJECT LOADING PALLET IN CONTAINER, AND TRANSFERRING METHOD

BACKGROUND OF THE INVENTION

1. Field of the Invention

The present invention relates to a pallet for a coiled carrying article, a loading structure for loading a coiled carrying article to a pallet, a containing structure for containing a coiled carrying article loading pallet into a container and a transport method.

More particularly, the present invention relates to a coiled carrying article pallet which can easily, deliberately transport a coiled carrying article into a container without damaging the article and which enables container transport for a coiled carrying article with transport cost held down, a loading structure for loading a coiled carrying article to the pallet, a containing structure for containing the coiled carrying article loading pallet into a container and a transport method.

2. Description of the Related Art

As wire rods which are dealt with in a coiled state (to be referred to as "coiled wire rods" hereinafter), there is known a wire rod which has a weight of about 2 t, a diameter of about 1200 to 1400 mm and an axial length of about 1300 mm. To transport such wire rods, a forklift, a crane or the like is often used.

In addition, to transport coiled wire rods by marine transport, bulk cargo by a usual bulk cargo ship is often employed. If coiled wire rods are transported by this method, the rods are strictly packaged with rust proof sheets or vinyl sheets one by one to prevent the rods from being damaged or rusted and cargo work is conducted for each packaged coiled wire rod.

With the transport method using the bulk cargo ship which handles bulk cargos, however, cargos in large quantities are transported once, which disadvantageously requires a large space (a warehouse or the like) to temporarily store the large quantities of cargos thus transported. In addition, this method disadvantageously requires labor for, for example, fixing cargos (which is referred to as "lashing") whenever transport means is to be changed.

Considering these disadvantages, there has been proposed container transport as a transport method for transporting coiled wire rods in small quantities. This container transport has advantages of shortening loading time and a transport period by handling the coiled wire rods for each container, saving a space which stores the coiled wire rods before and after the transport, and the like.

Nevertheless, according to the above-stated container transport, if coiled wire rods are transported into a container by transport means such as a forklift (a so-called vanning), the coiled wire rods are sometimes damaged by the pawls of the forklift or by being struck against the inner wall of the container or the floor face thereof. Further, since an operation for sending the coiled wire rods in the container is carried out based on spot articles, all the articles to be transported cannot be contained in the container.

Moreover, the coiled wire rods contained in the container are put on the container floor face while the axial direction of the rods oriented horizontally (in a so-called Eye-to-Wall state), that is, the peripheral sides of the coiled wire rods are put on the container floor face. Due to this, as in the case of the cargo ship transport stated above, it is necessary to strictly package the entire coiled wire rods using a rust proof sheet, a vinyl sheet or the like so as to prevent the coiled wire rods from being damaged or rusted. In addition, the coiled wire rods which are contained in the container are put horizontally and not vertically stacked so as not to be crushed or damaged, which considerably deteriorates efficiency for loading the coiled wire rods into the containers. Furthermore, it is necessary to fix the coiled wire rods which are contained in the container to the floor face, inner wall or the like of the container using ropes, lumbers or the like so as to prevent the rods from being tumbled down or moved. As a result, the transport cost of the conventional container transport for coiled wire rods is disadvantageously pushed up.

SUMMARY OF THE INVENTION

It is an object of the present invention to provide a pallet for a coiled carrying article which can easily, deliberately transport the coiled carrying article into a container without damaging the article and which enables container transport for the coiled carrying article while holding down transport cost.

It is another object of the present invention to provide a loading structure for loading a coiled carrying article to a pallet using the above-stated pallet.

It is yet another object of the present invention to provide a containing structure for containing a coiled carrying article loading pallet into a container using the above-stated pallet.

It is still another object of the present invention to provide a method for transporting a coiled carrying article loading pallet into a container using the above-stated pallet.

The invention will now be described following.

1. A pallet for a coiled carrying article contained in a container while a coiled carrying article is loaded on the pallet, comprising:

a pallet main body; and a mount section provided on said pallet main body, and capable of mounting an axial end face side of said coiled carrying article.

2. A pallet for a coiled carrying article according to claim 1, wherein said pallet main body has an abutment section which can be abutted on an inner wall of said container and other pallets, and when a predetermined number of pallets are contained in said container, said abutment section abuts on at least the other pallets and a predetermined number of coiled carrying articles loaded on said predetermined number of pallets, respectively are arranged in a zigzag fashion.

3. A pallet for a coiled carrying article according to claim 2, wherein said abutment section has a polygonal plane shape.

4. A pallet for a coiled carrying article according to claim 2, wherein said abutment section is in a form of a polygonal ring formed by forming a plurality of base materials into a frame.

5. A pallet for a coiled carrying article according to claim 1, wherein said pallet main body has a lower open space which is provided below said pallet main body and which is capable of inserting transport means for floating and transporting said pallet main body.

6. A pallet for a coiled carrying article according to claim 1, wherein said pallet main body has a leg section which can land on a floor face of said container.

7. A pallet for a coiled carrying article according to claim 6, wherein said leg section is constituted by orthogonally forming a plurality of base materials into a frame.

8. A pallet for a coiled carrying article according to claim 6, wherein said leg section is constituted by forming a plurality of base materials into a well crib-like frame.

9. A pallet for a coiled carrying article according to claim 1, wherein said mount section has an elastic member supporting said axial end face side of said coiled carrying article.

10. A pallet for a coiled carrying article according to claim 1, wherein said mount section has a pair of band insertion holes for a band binding and fixing said coiled carrying article, and a band insertion path coupling said pair of band insertion holes.

11. A pallet for a coiled carrying article according to claim 1, comprising a spacer member detachable from said pallet main body, wherein said pallet main body can abut on an inner wall of said container or the other pallets through said spacer member.

12. A pallet for a coiled carrying article according to claim 1, wherein when said coiled carrying article is not loaded, another pallet can be vertically stacked on the pallet.

13. A pallet for a coiled carrying article according to claim 1, wherein said coiled carrying article is formed by winding a wire rod into a coil.

14. A pallet for a coiled carrying article according to claim 1, wherein a diameter of said coiled carrying article is set to be larger than half a width of said container.

15. A pallet for a coiled carrying article according to claim 1, wherein said container is a dry container.

16. A loading structure for loading a coiled carrying article on a pallet, comprising:

said pallet for the coiled carrying article according to one of claims 1 to 15; and a coiled carrying article loaded on said pallet, wherein said coiled carrying article is mounted on said mount section of said pallet while said axial end face side of said coiled carrying article is being supported and an axial direction of said coiled carrying article is oriented vertically.

17. A containing structure for containing a coiled carrying article loading pallet into a container, comprising:

a predetermined number of pallets for the coiled carrying article according to one of claims 1 to 15;

a plurality of coiled carrying articles loaded on said predetermined number of pallets, respectively; and a container containing said predetermined number of pallets, wherein said pallet main body of each of said predetermined number of pallets abuts on at least the other pallets while said predetermined number of pallets are being contained in said container, and said plurality of coiled carrying articles loaded on said predetermined number of pallets are arranged in a zigzag fashion.

18. A method of transporting a coiled carrying article loading pallet into a container using said pallet for the coiled carrying article according to one of claims 1 to 15, comprising the step of:

transporting said pallet, on which said coiled carrying article is loaded with an axial direction oriented vertically, to said container by transport means.

19. A method according to claim 18, wherein when a predetermined number of said pallets are sequentially transported into said container by said transport means, said pallet main body of each of said predetermined number of pallets is abutted on the other pallets and a plurality of coiled carrying articles loaded on said predetermined number of pallets, respectively are arranged in a zigzag fashion.

The present invention makes it possible to provide a pallet for a coiled carrying article which can easily, deliberately transport the coiled carrying article into a container without damaging the article and which enables container transport for the coiled carrying article while holding down transport cost.

DETAILED DESCRIPTION OF THE INVENTION

Figure 1:
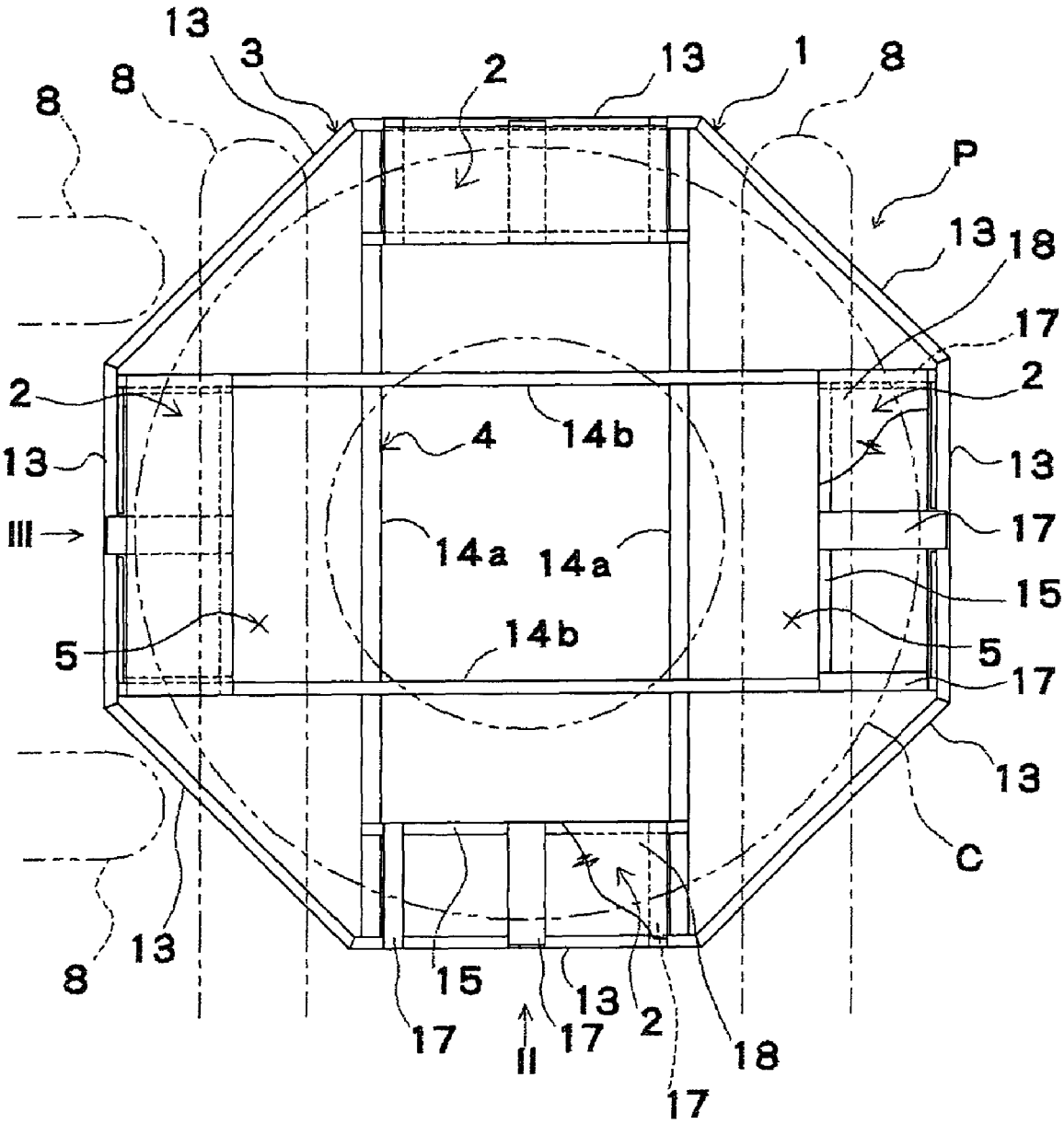
FIG. 1 is a plan view for explaining a coiled carrying article pallet according to the present invention.
Figure 2:
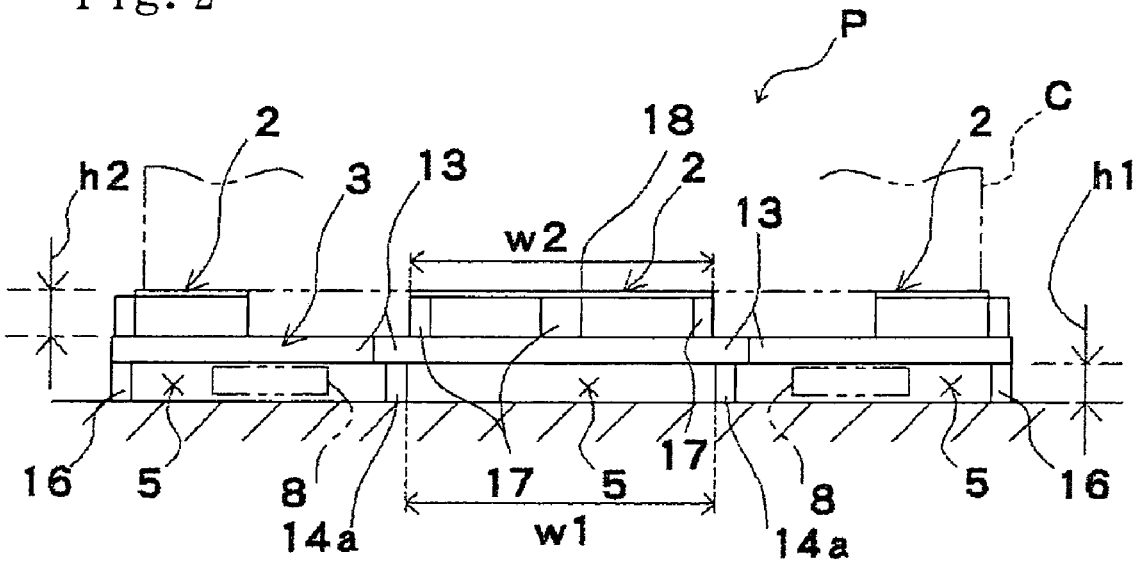
FIG. 2 is a side view seen from II side shown in FIG. 1.
Figure 3:
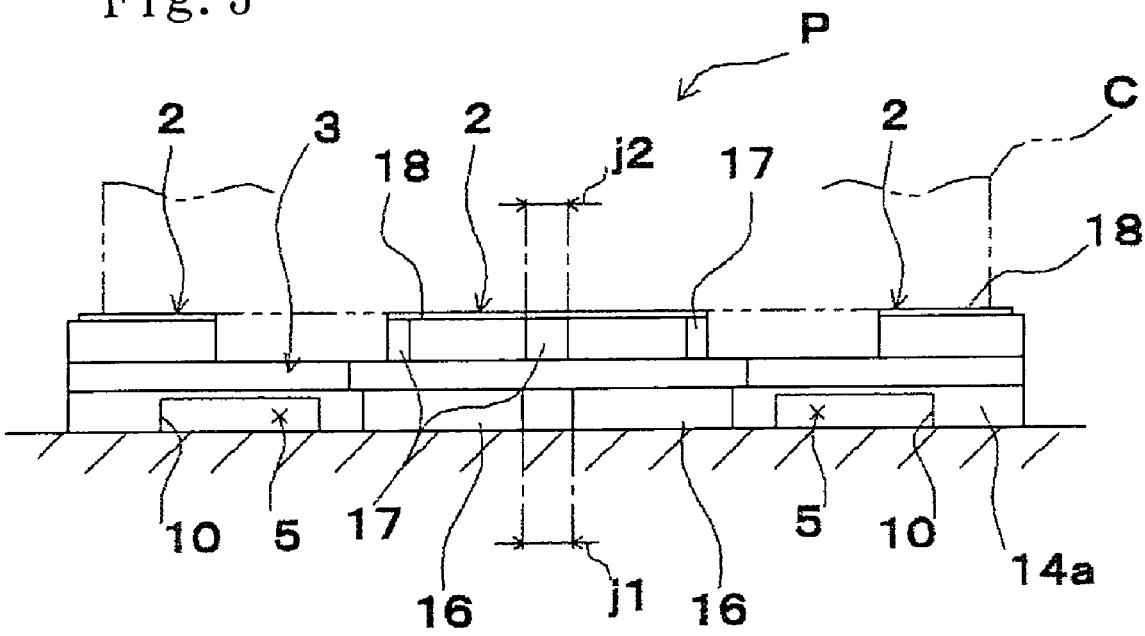
FIG. 3 is a side view seen from III side shown in FIG. 1.

The present invention will be described hereinafter in detail.

Pallet

A pallet for a coiled carrying article according to the present invention contained in a container while a coiled carrying article is loaded on the pallet, characterized by comprising: a pallet main body; and a mount section provided on the pallet main body, and capable of mounting an axial end face side of said coiled carrying article.

According to the pallet for the coiled carrying article of the present invention, it is possible to easily, deliberately transport the coiled carrying article into the container without damaging the article. In addition, since the coiled carrying article contained in the container is mounted on the floor face of the container while the axial direction of the article is set vertically (in a so-called Eye-to-sky state). Therefore, it is not required to strictly package the coiled wire rod and it is possible to improve efficiency for loading the coiled carrying article into the container. Besides, it is possible to minimize (basically dispense with) an operation for fixing the coiled carrying article to the container. Accordingly, container transport for the coiled carrying article can be realized while holding down transport cost.

The "pallet main body" has an abutment section which can be abutted on an inner wall of the container and other pallets, and when a predetermined number of pallets are contained in said container, said abutment section abuts on at least the other pallets and the predetermined number of coiled carrying articles loaded on the predetermined number of pallets, respectively can be arranged in a zigzag fashion. It is thereby possible to improve efficiency to contain a plurality of coiled carrying articles in container while the axial direction of the articles are set vertically.

"Arranged in a zigzag fashion" means a state in which the coiled carrying articles is arranged in a plurality of rows and the pitches of the adjacent rows are staggered in a row direction.

The "abutment section" can be constituted to have a polygonal plane shape, to be in a form of a polygonal ring formed by forming a plurality of base materials into a frame. By so constituting, it is possible to make the abutment section and, therefore, the pallet light in weight, simple and strong.

Further, the "pallet main body" can include a lower open space which is provided below the pallet main body and which is capable of inserting transport means for floating and transporting the pallet main body. This can facilitate transporting the pallet by transport means such as a forklift or the like.

It is noted that the "lower open space" can be constituted as a space in which at least one side of the sides of the pallet main body is opened. This means that it suffices to open only in one direction of forward, backward, right and left directions. In addition, this lower open space can be constituted as a space in which all of four sides of longitudinal and lateral sides are opened. By doing so, it is possible to improve the degree of freedom for a pallet transport direction in which transport means such as a forklift or the like transports the pallet. Further, the lower open space is normally constituted as a space in which the lower portion of the pallet main body is opened. Furthermore, the lower open space can be constituted not only as a space into which the transport means is inserted but also a space for fixing a fixing member (e.g., a band) employed to fix the coiled carrying article to the pallet or a space used for other arbitrary purposes.

Further, the pallet main body can include a leg section which can land on a floor face of said container. The "leg sections" can be constituted by orthogonally forming a plurality of base materials into a frame or by forming a plurality of base materials into a well crib-like frame. It is thereby possible to make the leg section and the pallet light in weight, simple and strong.

Moreover, the "mount section" can include an elastic member supporting the axial end face side of the coiled carrying article. It is thereby possible to appropriately load and support the coiled carrying article without damaging the axial end face of the coiled carrying article. In addition, the mount section can include a pair of band insertion holes for a band binding and fixing the coiled carrying article, and a band insertion path coupling the pair of band insertion holes. It is thereby possible to easily, strongly fix the coiled carrying article to the pallet.

Further, a detachable spacer member is mounted on the pallet main body, the pallet main body can abut on an inner wall of the container or the other pallets through the spacer member. As a result, even if the coiled carrying article has such a diameter as to slightly project out from the plane shape of the pallet, it is possible to prevent the peripheral surface side of the coiled carrying article from contacting with the coiled carrying article loaded on the other pallets or the inner wall of the container by the spacer means.

Further, when the coiled carrying article is not loaded, a stack support section can be provided to be able to vertically stack another pallet on the pallet. It is thereby possible to send back many empty pallets after transporting the coiled carrying articles while being stacked. It is also possible to save a storage space for storing the empty pallets.

The "coiled carrying article" may have arbitrary material, size and the like as long as the article is a cylindrical or columnar product formed by winding a wire rod or a band article into a coil. For example, the material of the wire rod or band article which constitutes the coiled carrying article is exemplified by steel, stainless steel, aluminum, synthetic resin, paper and the like. It is preferable that a diameter of the coiled carrying article is set to be larger than half a width of said container.

In addition, the "container" is exemplified by a special container such as an open top container or a flat container. However, it is preferable to employ a dry container for which a higher holding number is ensured, which is less expensive, easier to secure and more excellent in airtightness than these special container. It is also preferable to employ a dry container of 40 feet in view of loading efficiency.

Further, the "transport means" is preferably a transport device such as a forklift or the like which can go into the container from an opening portion on one end of the dry container. It is noted, however, if the coiled carrying article cannot be transported by the transport device such as a forklift (if the coiled carrying article weighs not less than 4 t, for example), it is preferable to employ, as the transport means, a floating transport device which can float and transport the coiled carrying article by spraying compressed air or the like downward, a sliding transport device which transport the article while sliding it, a car type transport device having wheels provided on a lower portion thereof, a transport device which suspends and transports the carrying article or the like.

(Loading Structure for Loading Coiled Transport Target Article on Pallet)

A loading structure for loading a coiled carrying article on a pallet according to the present invention is a loading structure for loading a coiled carrying article on a pallet comprising: the coiled carrying article loading pallet stated above; and a coiled carrying article loaded on the pallet, and characterized in that said coiled carrying article is mounted on the mount section of said pallet while the axial end face side of the coiled carrying article is being supported and an axial direction of the coiled carrying article is oriented vertically.

(Containing Structure for Containing Coiled Transport Target Article Loading Pallet into Container)

A containing structure for containing a coiled carrying article loading pallet into a container according to the present invention comprising: a predetermined number of pallets; a plurality of coiled carrying articles loaded on the predetermined number of pallets, respectively; and a container containing the predetermined number of pallets, characterized in that the pallet main body of each of the predetermined number of pallets abuts on at least the other pallets while the predetermined number of pallets are being contained in said container, and said plurality of coiled carrying articles loaded on the predetermined number of pallets are arranged in a zigzag fashion.

(Method of Transporting Coiled Transport Target Article Loading Pallet into Container)

A method of transporting a coiled carrying article loading pallet into a container according to the present invention using the pallet stated above, characterized by comprising the step of: transporting said pallet, on which the coiled carrying article is loaded with the axial direction oriented vertically, to said container by transport means. It is thereby possible to easily, deliberately transport the coiled carrying article into the container without damaging the article. It is advantageously possible to realize container transport for the coiled carrying article while holding down transport cost.

When a predetermined number of said pallets are sequentially transported into the container by the transport means, the pallet main body of each of the predetermined number of pallets can be abutted on the other pallets and a plurality of the coiled carrying articles loaded on the predetermined number of pallets, respectively can be arranged in a zigzag fashion. It is thereby possible to improve efficiency for loading the coiled carrying articles into the container and to realize container transport for the coiled carrying articles while further holding down transport cost.

(Method of Loading Coiled Carrying Article on Pallet)

A method of loading a coiled carrying article on a pallet using the pallet stated above, characterized by comprising the steps of: inverting the pallet set in a horizontal state to a vertical standing state; positioning an axial end face of the coiled carrying article with an axial direction directed horizontally relative to the mount section of the pallet; and then inverting the pallet to turn the pallet into a horizontal state together with the coiled carrying article to thereby load the coiled carrying article on the pallet. It is thereby possible to ensure and facilitate loading the coiled carrying article on the pallet without causing poor loading or the like.

Further, in the method of loading the coiled carrying article on the pallet, after said coiled carrying article is loaded on the pallet, the pallet and the coiled carrying can be bound together and fixed to each other by a band. It is thereby possible to further ensure loading the coiled carrying article on the pallet.

(Container Transport Method)

A container transport method can be characterized by transporting a container which stores the pallet stated above. It is thereby possible to realize container transport for the coiled carrying article while holding down transport cost.

EMBODIMENT

The present invention will be described more concretely based on an embodiment with reference to the drawings.

In this embodiment, a container A (see FIG. 12) which is normally referred to as "dry container of 40 feet" is employed as a container. The inside dimensions of the container A are set to have a length of about 12000 to 12100 mm, a width of about 2300 to 2400, and a height of about 2300 to 2400 mm. In this embodiment, as a coiled carrying article, a coiled carrying article C (see FIG. 12) formed by winding a wire rod made of metal (e.g., stainless steel or steel) with a predetermined number of turns and having a weight of about 2 t is employed. The diameter D of this carrying article C is set at about 1200 to 1300 mm to be not less than half of the width of the container A. In addition, the outer and inner peripheral sides of the carrying article C are bound with a plurality of steel bands (or resin bands). In this embodiment, a forklift F (see FIG. 10) is exemplified as a transport means for transporting a pallet.

(1) Configuration of Coiled Carrying Article Pallet

A pallet for a coiled carrying article according to the present invention is a pallet which is employed to store a carrying article in the container A and to transport the article. This pallet P is made of steel and consists of a pallet main body 1, and mount sections 2 which are provided on the pallet main body 1 as shown in FIGS. 1 to 4.

The pallet main body 1 includes an abutment frame section 3 (which is shown herein as "an abutment section") which can abut on the inner wall of the container A and other pallets P, and a leg section 4 which is provided in the inner region of the abutment frame section 3. This abutment frame section 3 is formed as a regular octagonal ring-like frame as a whole by preparing eight square pipe-like frame base materials 13 equal in outside dimension and fixing the end portions of these frame base materials 13 to one another by welding or the like. The plane dimension of this abutment frame section 3 basically has a regular octagonal shape which includes a circular region on the axial end face side of the carrying article C and is set to be able to contain a predetermined number of (twelve) pallets P in the container A as will be described later (see FIGS. 1 and 12).

In addition, the leg section 4 is formed by forming a pair of square pipe-like leg base materials 14*a* and a pair of leg base materials 14*b* into a well crib-like frame. The end portions of these pairs of leg base materials 14*a* and 14*b* are fixed to the inner surfaces of the frame base materials 13 by welding or the like. The paired leg base materials 14*a* are set to have a length protruding downward from the lower surface of the abutment frame section 3. A pair of auxiliary base materials 16 are provided at predetermined intervals to be fixed to the lower surfaces of the left and right frame base materials 13 which are parallel to the paired base materials 14*a*. The leg base materials 14*a* and the auxiliary base materials 16 enable the pallet P to stably land on the ground or the floor face of the container A.

In addition, the protrusion quantity h1 of each leg base material 14*a* by which the leg base material 14*a* protrudes downward from the lower surface of the abutment frame section is set to be slightly larger than the height h2 of the mount section 2. Moreover, the distance w1 of a pair of leg base material 14*a* is set slightly larger than a lateral width of a mount section 2 (see FIG. 2). Further, the distance j between the paired auxiliary base material 16 is set to be slightly larger than the width j2 of a central mount base material 17 which constitutes the mount section 2 (see FIG. 3).

Notches 10 with such a size as to insert the pawls 8 of a forklift F thereinto are formed halfway along the paired leg base materials 14*a*. A lower open space 5 which includes notch spaces formed by the notches 10 is formed below the abutment frame section 3. This lower open space 5 is a space in which the lower portion of the pallet main body 1 and the longitudinal and lateral directions thereof (vertical and lateral directions in FIG. 1) are opened. By inserting the pawls 8 of the forklift F into the lower open space 5, the pallet P is floated and transported. By thus making the lower open space 5 into a space which has four open sides in the longitudinal and lateral directions, it is possible to improve the degree of freedom for a transport direction in which the forklift F transports the pallet P and particularly to appropriately transport the pallet P on which carrying article C is loaded by an inverting machine to be described later.

Figure 5:
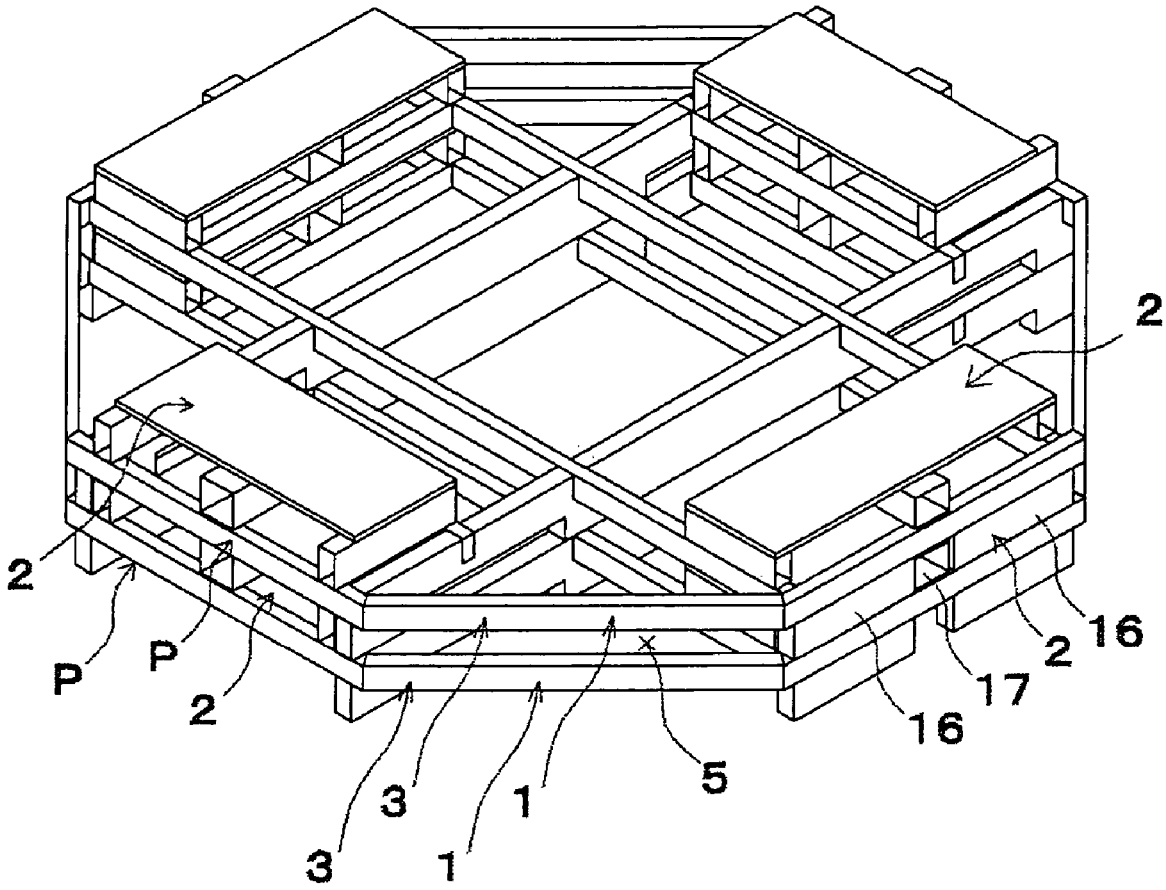
FIG. 5 is a perspective view showing a state in which pallets are vertically stacked.

Further, as shown in FIG. 5, if no carrying article C is loaded on the pallet P and the other pallet P is vertically stacked on the pallet P, then the mount sections 2 are stored in the lower open spaces 5 and the mount base materials 17 of the mount sections 2 are fitted between the paired auxiliary base materials 16, respectively, whereby the upper and lower pallets P are positioned relative to each other while the movements thereof are restricted by each other. In this embodiment, the auxiliary base materials 16, the mount section 2 and the like which constitute the pallet P, may be said to constitute "a stack support section" according to the present invention.

Figure 4:
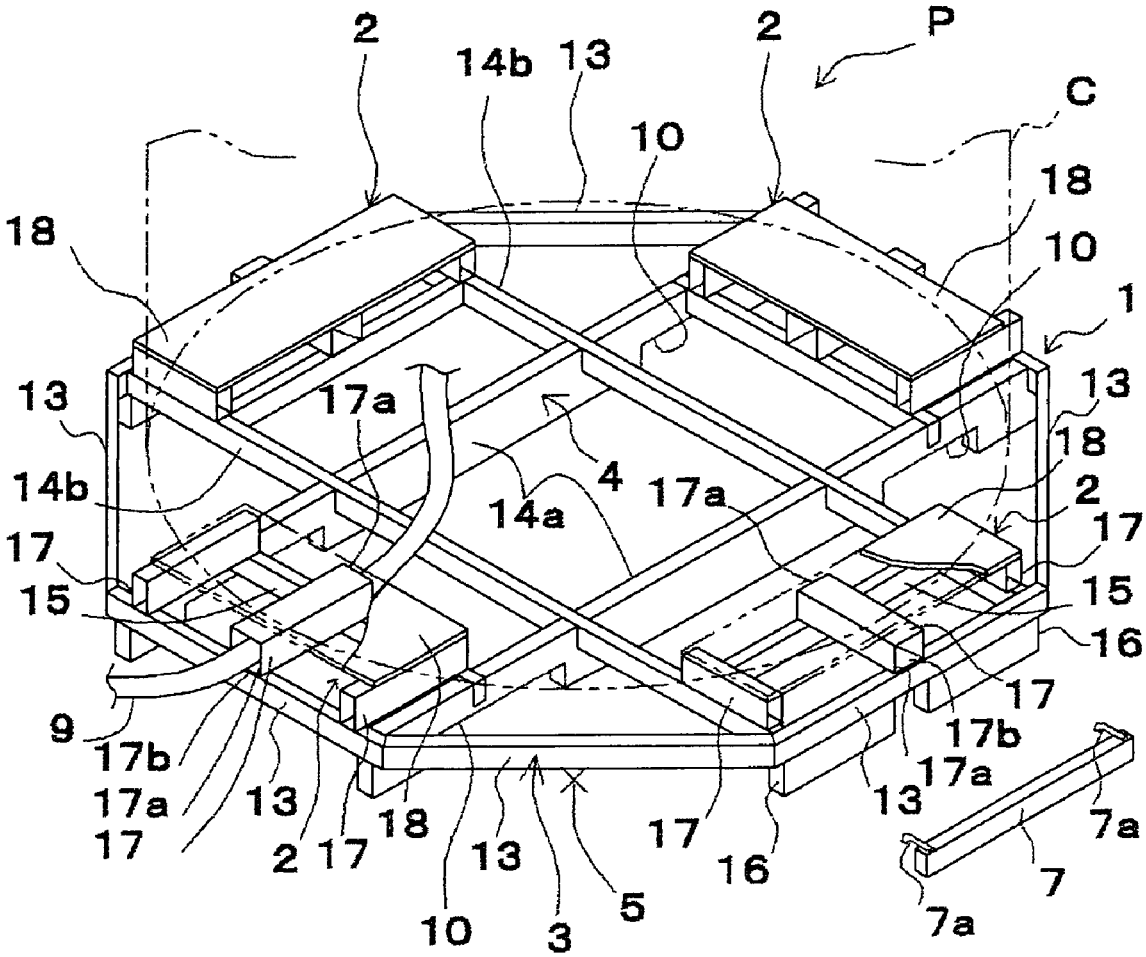
FIG. 4 is a perspective view for explaining the pallet.

The mount section 2 is in rectangular parallelopiped form and four mount sections 2 are circumferentially arranged on the upper surface of the pallet main body 1 at intervals of 90 degrees. Three square pipe-like mount base materials 17 are provided on the upper surface of a support base material 15 (see FIG. 1) among the predetermined frame base material 13 and the leg base materials 14*a* and 14*b*, and a thin plate-like rubber plate material 18 is fixed onto the upper surfaces of these mount base materials 17. The axial end face of the carrying article C is mounted and supported on the upper surfaces of the rubber plate materials 18 of the respective mount sections 2. Further, as shown in FIG. 4, the mount base materials 17 are formed into square pipes and the both ends of each mount base material 17 form a pair of band insertion holes 17*a* for a band 9 which binds and fixes the carrying article. In addition, the internal space of each mount base material 17 forms a band insertion path 17*b* which couples the paired band insertion holes 17*a*.

As shown in FIG. 4, stopper sections 7*a* of a steel spacer member 7 are freely engaged with and disengaged from each frame base material 13 of the abutment frame section 3. This spacer member 7 is employed if a carrying article C (e.g., carrying article C having a diameter of about 140 mm) which slightly projects out from the plane shape of the pallet P is loaded. The spacer member 7 prevents the peripheral surface of this large-diameter carrying article C from contacting with the inner wall of the container A or the carrying articles C loaded on the other pallets P.

As the spacer members 7, many spacer members 7 of one type to have a predetermined outside shape or a plurality of types of spacer members 7 having different outside shapes can be prepared and employed.

Figure 6:
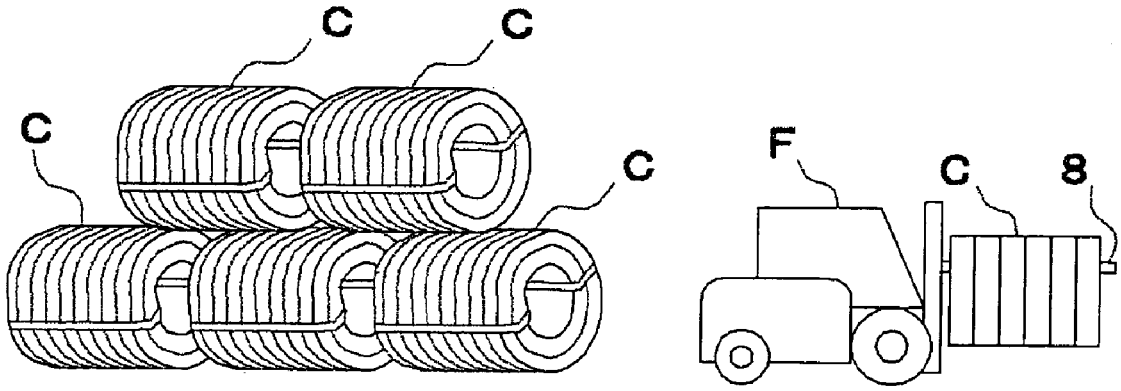
FIG. 6 is an explanatory view for function and showing a state in which carrying articles are transported from a storage location.

(2) Function of Transporting Coiled Carrying Article Loading Pallets into Container Next, the function of transporting carrying article loading pallets P into the container A will be described with reference to FIGS. 6 to 11. Before describing this function, the function of loading the carrying article C on the pallet P will be described. As shown in FIG. 6, carrying articles C to be transported among the many articles C which are stored in a predetermined storage space such as a warehouse or the like are transported close to an inverting machine 23 by the forklift F. At this moment, the carrying articles C are transported in a state in which pawls 8 are inserted into the hollow sections of the respective articles C and the articles C are put horizontally.

Figure 7:
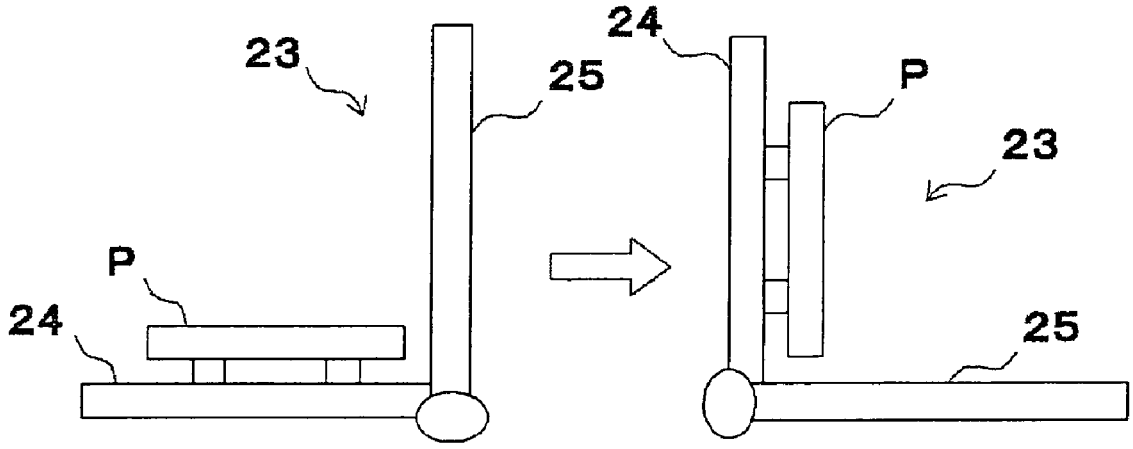
FIG. 7 is an explanatory view for function and showing a state in which an inverting machine performs an inversion operation.
Figure 8:
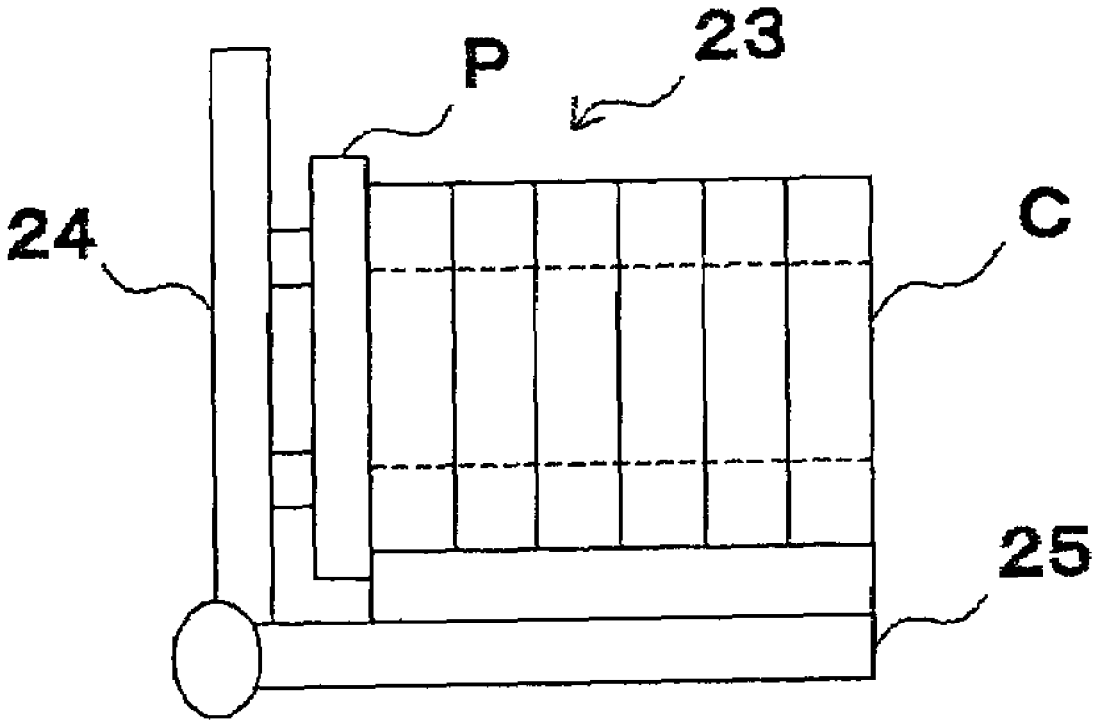
FIG. 8 is an explanatory view for function and showing a state in which carrying articles are mounted on the inverting machine.
Figure 9:
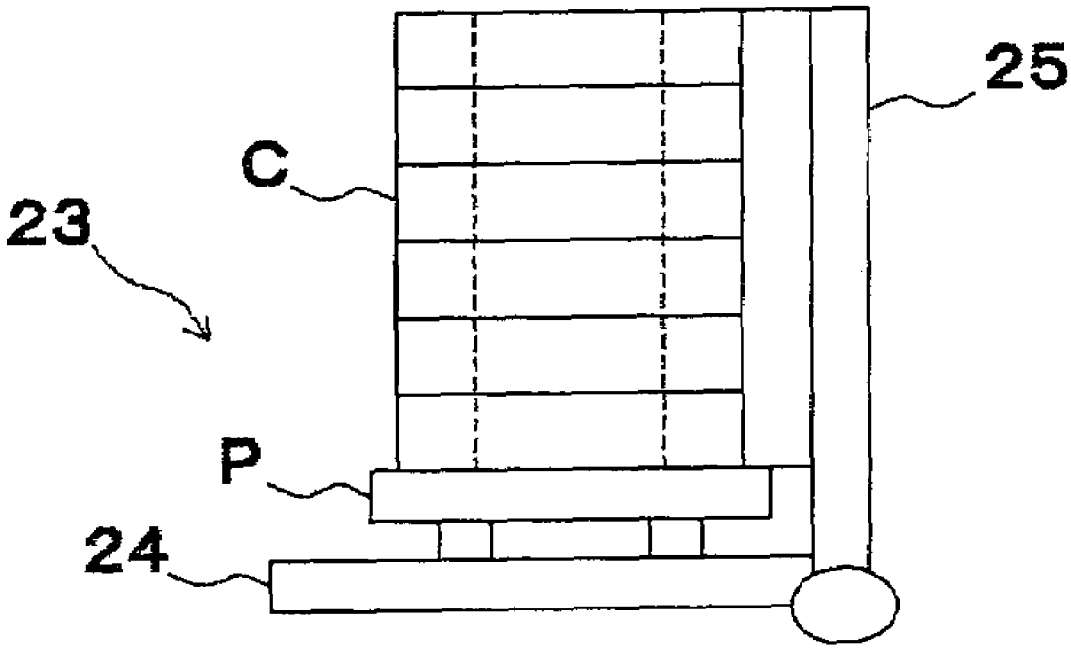
FIG. 9 is an explanatory view for function and showing a state in which the inverting machine performs an inversion operation.

Next, as shown in FIG. 7, the inverting machine 23 attaches the pallet P to a pallet support base 24 in a horizontal state appropriately by a clamper or the like, and inverts this pallet support base 24 together with the pallet P by 90 degrees to put the pallet P vertically. Thereafter, as shown in FIG. 8, the carrying article C is put horizontally on the horizontal transport support base 25 by the forklift F, the crane or the like to put the axial end face of this carrying article C on the mount section of the pallet P. As shown in FIG. 9, the inverting machine 23 oppositely inverts the transport support base 25 together with the carrying articles C by 90 degrees to thereby mount the carrying article C on the pallet P vertically with the axial direction of the article C oriented vertically. In this state, the band 9 is inserted into each band insertion path 17*b* through the paired band insertion holes 17*a*, the both ends of the band 9 are bound together through the hollow section of the carrying article C and the carrying article C and the pallet P are thereby fixedly, integrally bound (see FIG. 4). By repeating this operation a predetermined number of times (twelve times), twelve carrying article loading pallets P on which the carrying articles C are loaded, respectively, are prepared.

Figure 10:
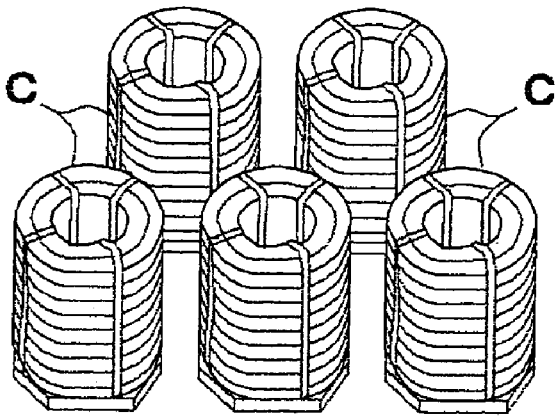
FIG. 10 is an explanatory view for function and showing a state in which carrying article loading pallets are transported from a storage location.
Figure 10:
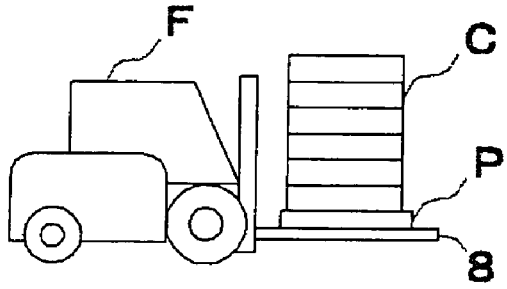
Figure 11:
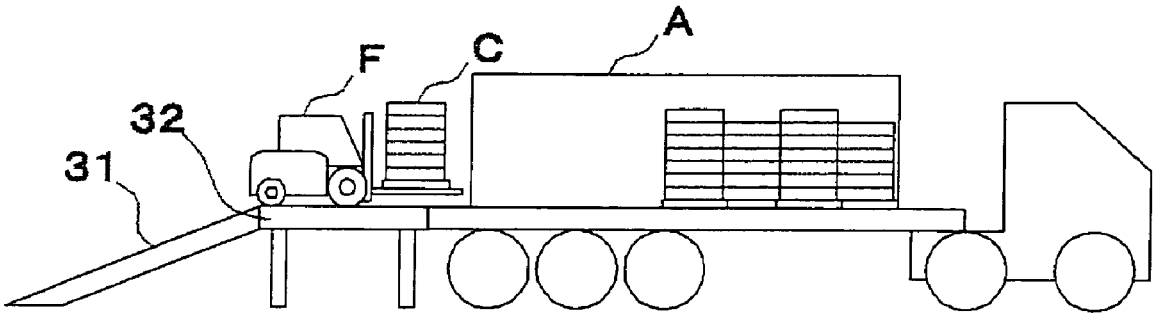
FIG. 11 is an explanatory view for function and showing a state in which the carrying article loading pallets are transported into a container.

Next, as shown in FIG. 10, the carrying article loading pallet P which is temporarily mounted is transported close to the container A by the forklift F. At this moment, the pawls 8 are inserted into the lower open space 5 of the pallet P and the carrying article C is transported while being kept vertically. As shown in FIG. 11, the forklift F goes into the container A through a slope 31 and a stage 32, the carrying article loading pallets P are sequentially transported into the container A from the deep side thereof and the twelve carrying article loading pallets P are eventually contained in the container A. Thereafter, this container A is transported by land with a container truck or the like or by sea with a container ship or the like.

A process for sending the carrying articles C in the container A and transporting the articles C toward a destination has been described so far in detail. An operation for taking out the carrying articles which have been transported to the destination from the container A can be handled by adopting opposite procedures to those of the above-stated sending-in operation.

Figure 12:
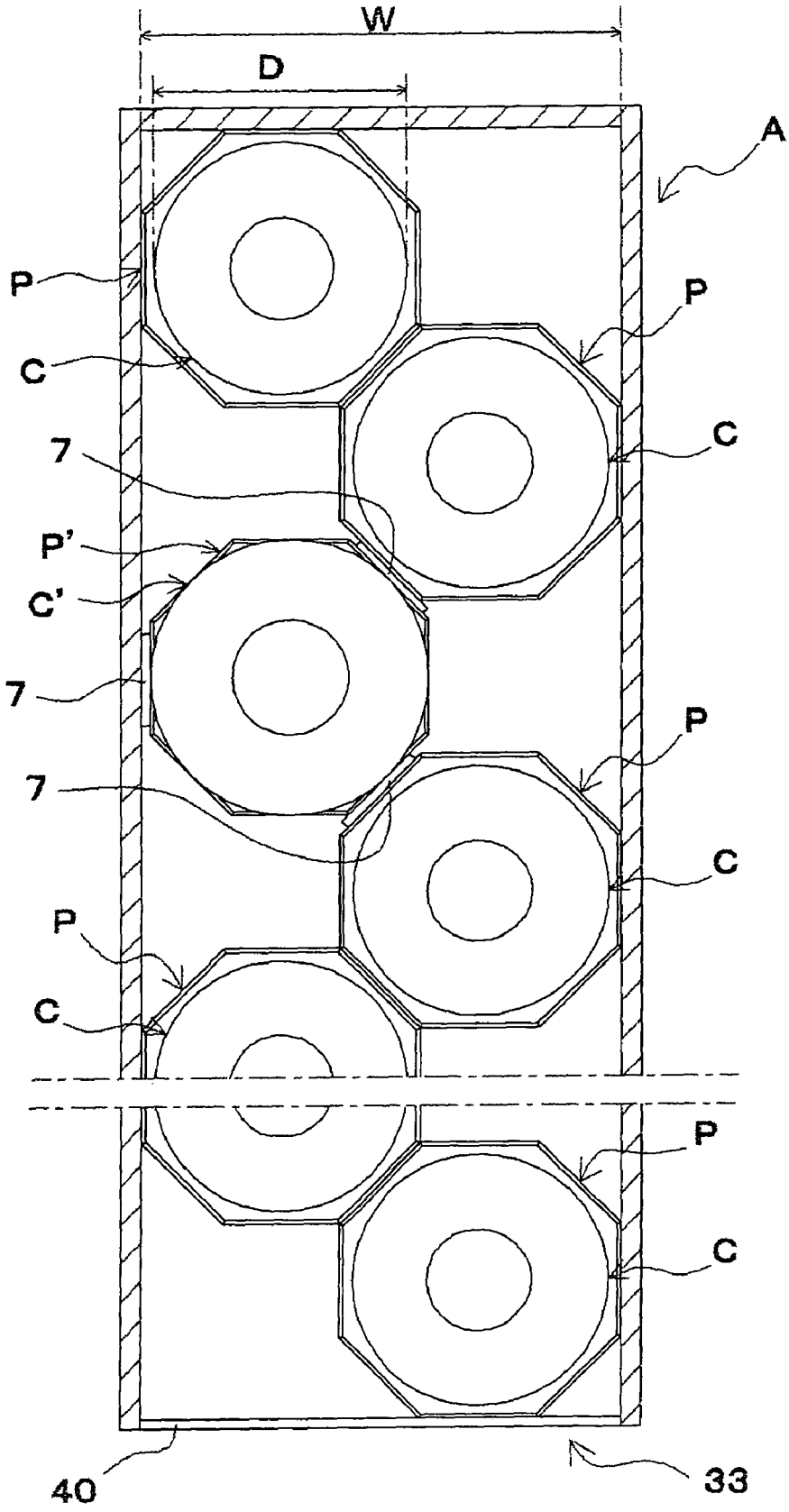
FIG. 12 is an explanatory view for explaining a state in which carrying article loading pallets are contained into the container.

Meanwhile, as shown in FIG. 12, while the carrying article loading pallets P are contained in the container A, each pallet P is positioned so that the frame base materials of the abutment frame section 3 of each pallet P abut on the inner walls (sidewalls or longitudinal walls) of the container A and also on the other pallets P. The carrying articles C loaded on these pallets P, respectively, are arranged in a zigzag fashion so that the adjacent carrying articles are overlapped in longitudinal and lateral directions.

A carrying article C' which is loaded on a pallet P' is a large-diameter carrying article C' which projects out from the plane of the pallet P'. Three spacer members 7 are attached to this pallet P' and the pallet P' abuts on the inner wall of the container A and the other pallets P through these spacer members 7. If no spacer members 7 are employed, the container A is designed to generate a clearance of about 500 mm on the opening side 33 of the container A and a spacer member 40 is appropriately fitted into this clearance.

(3) Advantages of Embodiment

As described above, in this embodiment, the pallet P on which the coiled carrying article C is loaded can be easily transported into the dry container A which has the opening section 33 only on the rear end side thereof, by the forklift F. It is, therefore, possible to realize container transport for the coiled carrying article C, to protect the carrying article C by the container A, to shorten loading time and transport period, to save storage spaces before and after the transport (actual location and destination), and to facilitate inventory management and the like.

Further, in this embodiment, the carrying article C is transported into the container A using the pallet P. It is, therefore, possible to prevent the pawls 8 of the forklift F from directly contacting with the carrying article C and to prevent the carrying article C from being damaged as much as possible, compared with the conventional transport system of directly transporting the carrying article by the forklift. In addition, the plane shape of the abutment frame section 3 of the pallet P is set to have a larger region than the axial end face of the coiled carrying article C. Due to this, even if an operator erroneously operates the transport of the carrying article C, the abutment frame section 3 abuts on the inner wall and floor face of the container A, making it possible to prevent the carrying article C from being directly struck against the inner wall and floor face of the container A and to thereby prevent the carrying articles C from being damaged as much as possible. Besides, it is possible to ensure transporting all the carrying articles to be transported into the container A and to thereby deliberately execute the transport of the carrying articles C into the container A.

Moreover, in this embodiment, the carrying articles C contained into the container A are mounted on the floor face of the container A with the axial direction set vertically and the outer peripheral sides of the articles C are out of contact with the inner wall of the container A and the carrying articles C on the other pallets P. Therefore, it is possible to dispense with a laborious operation for, for example, strictly packaging the entire carrying articles C by a vinyl sheet or the like.

Furthermore, in this embodiment, the carrying articles C contained in the container A are mounted on the floor face of the container A with the axial direction thereof set vertically and adjacent articles among a predetermined number of (twelve) carrying articles C loaded on the respective pallets are arranged in a zigzag fashion to be overlapped in longitudinal and lateral directions. Due to this, compared with the conventional system of containing the coiled carrying articles C with the axial direction thereof set horizontally, it is possible to greatly improve efficiency for loading the carrying articles C into the container A. In particular, even if the diameter D of each coiled carrying article C is larger than half the width W of the container A, it is possible to improve loading efficiency.

Further, in this embodiment, the coiled carrying articles C are transported into the container A using the respective pallets P. It is, therefore, possible to conduct operations for fixing and detaching the carrying articles C to and from the pallets P outside of the container A. Compared with a conventional system which requires a complicated operation for fixing the carrying articles in a narrow container, it is possible to carry out the transport operation for transporting the carrying articles C easily in short time. Further, in this embodiment, the abutment frame sections 3 of the adjacent pallets P abut on each other, so that the movements of a predetermined number of (twelve) pallets P which are contained in the container A are restricted and the pallets are positioned to such an extent that the articles are not poorly loaded. It is, therefore, possible to dispense with operations for fixing and detaching the pallets P to and from the container A and to thereby simply carry out the transport operation for transporting the carrying articles C in short time.

Furthermore, in this embodiment, a plurality of pallets P can be vertically stacked while the mount sections 2 are stored in the lower open spaces 5 of the respective pallets 2. It is, therefore, possible to stack many empty pallets P and send back the pallets compactly after transporting the carrying articles and to save a storage space for the empty pallets P. Besides, in this embodiment, since the upper surface of each mount section 2 is constituted out of the rubber plate material 18, it is possible to prevent the axial end faces of the coiled carrying articles C which are mounted on the mount sections 2, from being damaged as much as possible. In addition, since a pair of band insertion holes 17*a* and the band insertion path 17*b* are provided in the mount section 2, it is possible to integrally fix the coiled carrying articles C to the respective pallets P by the band 9 more strongly, thereby making it possible to easily carry out a fixing operation in short time.

The present invention is not limited to the concrete embodiment stated above but various changes and modifications can be made to the invention within the scope of the invention 3 according to purposes and usages. Namely, in this embodiment, the ring-like frame is exemplified as the abutment frame section of the pallet P. However, the abutment frame section is not limited to this shape but, for example, may be a flat or box-like abutment section. In addition, the abutment frame section 3 is constituted to have a regular octagonal plane shape. However, the abutment frame section 3 is not limited thereto. The abutment frame section 3 may have a regular polygonal plane shape such as a regular dodecagonal plane shape, a polygonal plane shape such as an octagonal plane shape having unequal edges or a circular, elliptical or heteromorphic plane shape. In this embodiment, the well crib-like frame is exemplified as the leg section 4 of the pallet P. However, the leg section is not limited thereto but may be a cruciform, flat or box-like leg section.

Further, in this embodiment, a case in which the diameter D of the coiled carrying article C is slightly larger than half the width W of the container A and in which a manner of efficiently containing the carrying articles C into the container A (arranging the articles in two rows in a zigzag fashion) has been exemplified. However, the present invention is not limited to this case. For example, if the diameter of each coiled carrying article is slightly larger than a third of the width of the container, the coiled carrying articles may be arranged in three rows in a zigzag fashion in the container. In that case, the pallets in the central row do not abut on the inner wall of the container and the movements of the pallets are restricted only by the abutment thereof on the other pallets. Further, in this embodiment, the coiled carrying articles C are arranged in a zigzag fashion so as to improve efficiency for loading the coiled carrying articles into the container A. However, the present invention is not limited to this arrangement. For example, the coiled carrying articles C may be arranged in one row along the longitudinal direction of the container A or arranged in a plurality of rows so that the pitches of the adjacent rows are aligned to the row directions.

In this embodiment, a case of employing the pallets P equal in size and shape has been described. However, the pallets are not limited thereto. A combination of a plurality of types of pallets having different sizes and shapes may be employed. In that case, it is possible to increase the number of thin coiled carrying articles to be loaded into the container. It is possible to load even thick coiled carrying articles without projecting out from the pallets. Thus, it is possible to efficiently load the articles into the container using appropriate pallets according to coil size. Further, in this embodiment, a case of preparing a plurality of (twelve) pallets P and loading one carrying article C on each pallet P has been described. However, the present invention is not limited thereto. For example, a plurality of carrying articles may be loaded on one pallet. In addition, the pallets are employed for not only the dry container of 40 feet shown in this embodiment but also a 20-feet dry container having different size or the like and for an open top container or the like.

As a modification, not the coiled carrying articles but non-coiled, i.e., cylindrical carrying articles, columnar carrying articles or the like which consist of single formed products may be used. It is also possible to employ one rod-like carrying article, a carrying article assembly obtained by binding rod materials and the like. The shapes of the mount sections of the pallets which are employed for these cases may be selected arbitrarily as long as the carrying articles to be used can be loaded on the pallets.

What is claimed is:

1. A pallet for a coiled carrying article contained in a container while a coiled carrying article is loaded on the pallet, comprising:

a pallet main body; and a mount section provided on said pallet main body, and capable of mounting an axial end face side of said coiled carrying article, wherein said pallet main body has a leg section which can land on a floor face of said container and said leg section is constituted by orthogonally forming a plurality of base materials into a frame, wherein said mount section has a plate-shaped elastic member which is fixed on an upper surface of said mount section and supports said axial end face side of said coiled carrying articles, and has a pair of band insertion holes for a band binding and fixing said coiled carrying article, and a band insertion path coupling said pair of band insertion holes, wherein said pallet main body has an abutment section which can be abutted on an inner wall of said container and other pallets, and when a predetermined number of pallets are contained in said container, said abutment section abuts on at least the other pallets and a predetermined number of coiled carrying articles loaded on said predetermined number of pallets, respectively are arranged in a zigzag fashion, and wherein said abutment section is in a form of a polygonal ring formed by forming a plurality of base materials into a frame.

2. A pallet for a coiled carrying article according to claim 1, wherein said abutment section has a polygonal plane shape.

3. A pallet for a coiled carrying article according to claim 1, wherein said pallet main body has a lower open space which is provided below said pallet main body and which is capable of inserting transport means for floating and transporting said pallet main body.

4. A pallet for a coiled carrying article according to claim 1, wherein said leg section is constituted by forming a plurality of base materials into a well crib-shaped frame.

5. A pallet for a coiled carrying article according to claim 1, comprising a spacer member detachable from said pallet main body, wherein said pallet main body can abut on an inner wall of said container or the other pallets through said spacer member.

6. A pallet for a coiled carrying article according to claim 1, wherein when said coiled carrying article is not loaded, another pallet can be vertically stacked on the pallet.

7. A pallet for a coiled carrying article according to claim 1, wherein a coiled carrying article is formed by winding a wire rod into a coil.

8. A pallet for a coiled carrying article according to claim 1, wherein a diameter of a coiled carrying article is set to be larger than half a width of a container.

9. A pallet for a coiled carrying article according to claim 1, wherein a container is a dry container.

10. A pallet for a coiled carrying article contained in a container while a coiled carrying article is loaded on the pallet, comprising:

a pallet main body; and a mount section provided on said pallet main body, and capable of mounting an axial end face side of said coiled carrying article, wherein said pallet main body has a leg section which can land on a floor face of said container and said leg section is constituted by orthogonally forming a plurality of base materials into a frame, wherein said mount section has a plate-shaped elastic member which is fixed on an upper surface of said mount section and supports said axial end face side of said coiled carrying article, and has a pair of band insertion holes for a band binding and fixing said coiled carrying article, and a band insertion path coupling said pair of band insertion holes, wherein said pallet main body has an abutment section which can be abutted on an inner wall of said container and other pallets, and when a predetermined number of pallets are contained in said container, said abutment section abuts on at least the other pallets and a predetermined number of coiled carrying articles loaded on said predetermined number of pallets, respectively are arranged in a zigzag fashion, wherein said abutment section is in a form of a polygonal ring formed by forming a plurality of base materials into a frame; and further comprising:

a predetermined number of pallets for the coiled carrying article;

a plurality of coiled carrying articles loaded on said predetermined number of pallets, respectively; and said container containing said predetermined number of pallets, wherein said pallet main body of each of said predetermined number of pallets abuts on at least the other pallets while said predetermined number of pallets are being contained in said container, and said plurality of coiled carrying articles loaded on said predetermined number of pallets are arranged in a zigzag fashion.

11. A method of transporting a coiled carrying article loading pallet into a container using said pallet for the coiled carrying article according to claim 1; comprising the step of:

transporting said pallet, on which said coiled carrying article is loaded with an axial direction oriented vertically, to said container by transport means.

12. A method according to claim 11, wherein when a predetermined number of said pallets are sequentially transported into said container by said transport means, said pallet main body of each of said predetermined number of pallets is abutted on the other pallets and a plurality of coiled carrying articles loaded on said predetermined number of pallets, respectively are arranged in a zigzag fashion.

13. A containing structure according to claim 10, wherein said pallet main body of each of said predetermined number of pallets has an abutment frame section which is in a form of a regular octagonal ring formed by forming a plurality of frame base materials into a frame, each of said predetermined number of pallets is positioned so that said frame base materials of said abutment frame section of each of said predetermined number of pallets abut on the inner walls of said container and on the other pallets while said predetermined number of pallets are being contained in said container, and said plurality of coiled carrying articles loaded on said predetermined number of pallets are arranged in two rows in a zigzag fashion.

14. A method according to claim 12, wherein said pallet main body of each of said predetermined number of pallets has an abutment frame section which is in a form of a regular octagonal ring formed by forming a plurality of frame base materials into a frame, when a predetermined number of said pallets are sequentially transported into said container by said transport means, each of said predetermined number of pallets is positioned so that said frame base materials of said abutment frame section of each of said predetermined number of pallets abut on the inner walls of said container and on the other pallets, and said plurality of coiled carrying articles loaded on said predetermined number of pallets are arranged in two rows in a zigzag fashion.

* * * * *